US006032743A

United States Patent [19]

Bowlin et al.

[11] Patent Number: 6,032,743

[45] Date of Patent: Mar. 7, 2000

[54] METHOD AND APPARATUS FOR REDUCING GAS WELL PRODUCTION COSTS USING IMPROVED DOWNHOLE VALVES

[75] Inventors: Kevin Rush Bowlin; Howard Lee McKinzie; Carlos Walter Pardo, all of Sugar Land, Tex.

[73] Assignee: Texaco Inc., White Plains, N.Y.

[21] Appl. No.: 08/581,864

[22] Filed: Jan. 2, 1996

[51] Int. Cl.[7] ..... E21B 43/12

[52] U.S. Cl. ..... 166/369; 166/105; 166/106

[58] Field of Search ..... 166/369, 106, 166/105, 105.5; 417/535

[56] References Cited

U.S. PATENT DOCUMENTS

| | | | |
|---|---|---|---|
| 2,281,801 | 5/1942 | Reynolds et al. | 166/106 X |
| 3,199,592 | 8/1965 | Jacob | 166/106 |
| 5,176,216 | 1/1993 | Slater et al. | 166/105.5 |
| 5,296,153 | 3/1994 | Peachey | 210/787 |
| 5,425,416 | 6/1995 | Hammeke et al. | 166/105.5 |
| 5,497,832 | 3/1996 | Stuebinger et al. | 166/369 |
| 5,579,838 | 12/1996 | Michael | 166/106 |

*Primary Examiner*—Hoang C. Dang
*Attorney, Agent, or Firm*—Henry H. Gibson; William J. Beard

[57] ABSTRACT

Methods and apparatus are disclosed for reducing lifting costs in a producing hydrocarbon well by injecting produced water into a set of injection perforations located lower in the well borehole from a set of production perforations. A plunger pump and a cage-ball valve system are placed above a production packer which is located between the production and injection perforations. The valve system and pump are arranged to take produced water from above the packer and pump into the injection perforations only on the downstroke of the rod string activated plunger pump.

10 Claims, 4 Drawing Sheets

METHOD AND APPARATUS FOR REDUCING GAS WELL PRODUCTION COSTS USING IMPROVED DOWNHOLE VALVES

REFERENCE TO RELATED APPLICATIONS

This application is related to and is an improvement of systems described in prior application Ser. No. 08/286,361 filed Aug. 5, 1994, for "DUAL ACTION PUMPING SYSTEM", now issued as U.S. Pat. No. 5,497,832.

BACKGROUND OF THE INVENTION

The invention described herein pertains to a method and apparatus for improving the economics of production from a producing well. While the descriptions of the invention contained herein are given with respect to producing gas wells, it will be understood by those of skill in the art that they are also applicable to producing oil wells for the reduction of lifting costs therein.

A problem associated with the production of oil and gas throughout the history of the industry has been that of the disposal of undesired water produced along with the desired oil or gas. The above referenced co-pending application deals with the re-injection of produced water into an injection zone lower in the producing well. The produced water is separated by using the casing-production tubing annulus as a gravity separator in the wellbore in a producing oil well. The oil is pumped to the surface and the produced water is pumped into a set of injection perforations lower in the wellbore, and sealed off interior to the casing from the producing perforations by a production packer. This packer is penetrated by a tubing string connected to a dual action mechanical pump located above the packer which pumps oil to the surface on the upstroke of the pump, and which pumps water into the injection perforations below the packer on the downstroke of the pump.

The pumping system described in the referenced co-pending application has been in operation a sufficient time to permit observation of some weaknesses in the system. One such weakness, which the present invention addresses, is that of the valving used to selectively pick up the water or oil for pumping to the injection perforations or to the surface respectively. The valves used in the referenced application had relatively small cross sectional area, necessitating the use of a plurality of such valves. This can lead to earlier failure because of a multiplicity of parts. Also the valves previously used were of a spring loaded or biased type, which used spring pressure to assist in the opening and closing of valves. The use of springs in the high temperature, often corrosive, well fluid environment would be better avoided, if possible. The present invention does so by completely eliminating the use of spring operated or assisted valves.

Typically gas wells flow to the surface using the reservoir pressure as a means of lifting the gas which is produced into the cased well borehole through production perforations and is allowed to enter a production tubing string run coaxially into the casing and extending from the surface down to the producing zone. Over time, essentially all gas producing wells also produce unwanted water along with the gas into the casing. This builds up a hydrostatic pressure head in the casing-tubing annulus which must be overcome by the formation pressure, or by a pumping system, to produce gas and fluid to the surface through the tubing string or the casing-tubing annulus.

The production of salt water creates a water handling problem. The water is conventionally separated at the surface in gravity or other type separators and is then re-injected into a disposal well or hauled off by truck to be disposed of. A typical way of reducing the undesired hydrostatic head problem, which slows gas production, is to pump the water to the surface and to allow gas to flow to the surface in the tubing-casing annulus. Again, this creates a water disposal problem. The reinjection of water downhole in a manner similar to that disclosed in the above referenced patent application can significantly reduce lifting costs and can virtually eliminate waste water disposal problems.

BRIEF DESCRIPTION OF THE INVENTION

The present invention operates in an improved manner to re-inject produced salt water from a set of upper producing perforations into a set of lower injection perforations in a well borehole. The cased hole is provided with a production packer to interiorly separate the upper production perforations from the lower injection perforations. A pumping system is run into the casing on a string of production tubing. The pumping system uses a combination system of two valves. This valve combination is set below a conventional mechanical pump with a plugged plunger. There is an upper ball in cage valve, and a lower ball in cage valve. On the upstroke of the pump cycle water enters the tubing beneath the pump but above the packer through a port in the upper valve beneath the conventional cage-ball seat. Also on the upstroke, the lower cage-ball valve seats preventing water flow from the injection interval (below the packer) into the production tubing penetrating the packer. On the downstroke of the pump, the upper cage-ball valve seats (closes) and water is forced by the pump plunger through both valves and the tubing into the lower injection interval below the packer. Thus water is pumped for re-injection on the downstroke of the cycle and gas flows to the surface in the casing-tubing annulus.

The above and other features and advantages of the invention are best understood by reference to the following detailed description thereof when taken in conjunction with the accompanying drawings. These descriptions and drawings are intended as illustrative of the invention and not as limitative thereof.

BRIEF DESCRIPTION OF THE DRAWINGS

The appended drawings comprise 7 figures which are.

DETAILED DESCRIPTION OF THE INVENTION

Figure 1:
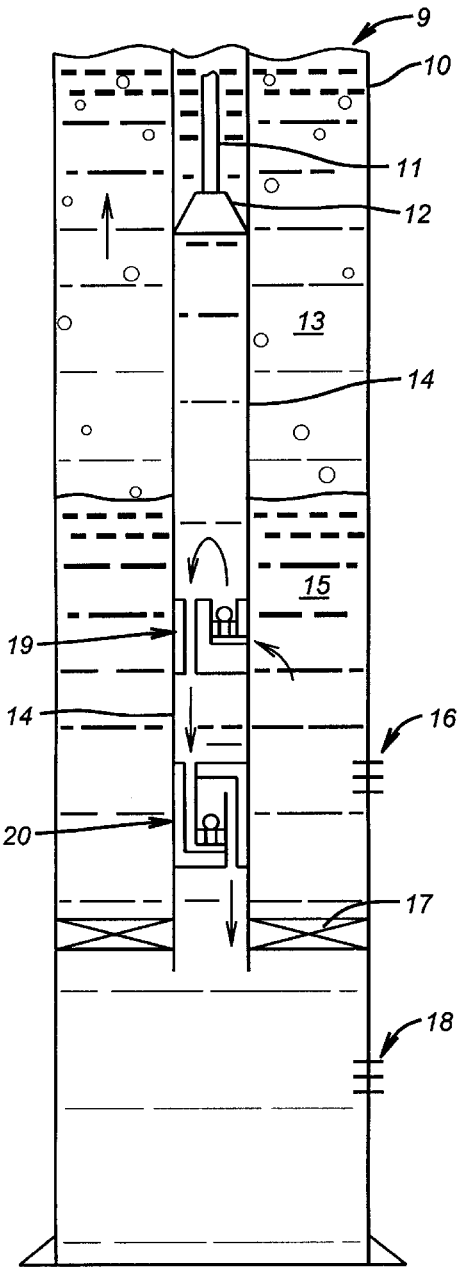
FIG. 1 is a schematic cross-section of a wellbore employing the pumping and valving system of the invention in a gas well.

Referring initially to FIG. 1 of the drawings a hydrocarbon producing well is schematically illustrated in which is provided a water disposal system according to the concepts of the present invention. A cased wellbore production interval is shown generally as numeral 9. A well casing 10 is cemented in place over the gas producing zone outside the casing 10 and extends to the surface of the earth. A production tubing string 10 is run into the borehole 9 and contains a plugged plunger pump 12, illustrated schematically operated by a rod string 11 which extends to the surface. A valve assembly according to the concepts of the present invention is shown schematically in the tubing string 14 below the pump 12 and comprises an upper ball valve 19 and a lower ball valve 20 whose operation will be described in more detail subsequently.

The producing zone produces gas and water into casing 10 through production perforations 16. The casing 10 is also provided with a set of lower injection perforations 18 which are separated from and sealed off from the production perforations 16 (interiorly to the casing 10) by a production packer 17. The tubing string 14 penetrates packer 17 via the valve assembly 19-20.

As gas and water is produced into casing 10 through perforations 16 it separates into an upper gas layer 13 in the casing-tubing annulus and a lower water layer 15 also in the casing-tubing annulus. As more water is produced a hydrostatic pressure head is built up over the perforations 16. Formation pressure may become insufficient to overcome this head and the production of fluids from the formation slows down. In order to reduce or eliminate the head, water is pumped to the surface via a tubing pump in conventional production. This is costly and produces a water disposal problem. The system of the present invention eliminates the need to pump water to the surface as it is re-injected into the producing formation (or into a lower disposal formation) via the injection perforations 18.

In operation the up and down motion of the rod string 11 and plugged plunger pump 12 is used to inject, via valve assembly 19-20, produced water is through packer 17 and injected perforations 18, back into the formations exterior to casing 10. On the upstroke of rod string 11 and pump 12, water is allowed to enter the tubing string via upper valve 19 which unseats or opens on this upstroke. Also on the upstroke, the lower valve 20 closes or seats. This prevents entry of water in to the tubing string 14 from below packer 17. On the downstroke of rod string 11 and pump 12, upper valve 19 closes, preventing entry of water into tubing string 14 and effectively sealing off the casing-tubing annulus above the packer 17. Also on the downstroke, the lower valve 20 opens, or unseats. This allows the pump 12 to force the water inside the tubing string 14 down through packer 17 and into the disposal injection perforations 18.

Figure 2:
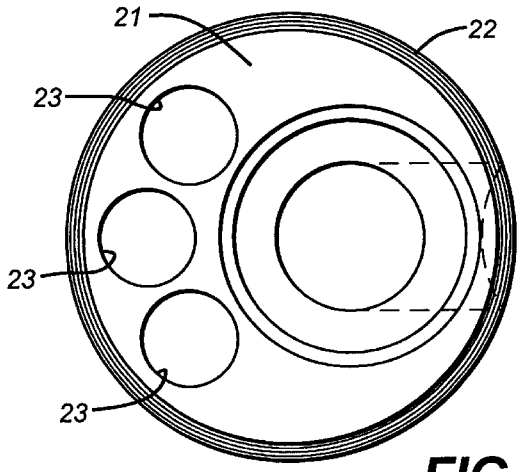
FIG. 2 is a schematic cross-sectional view looking down on the upper end of the upper valve assembly of the system.
Figure 3:
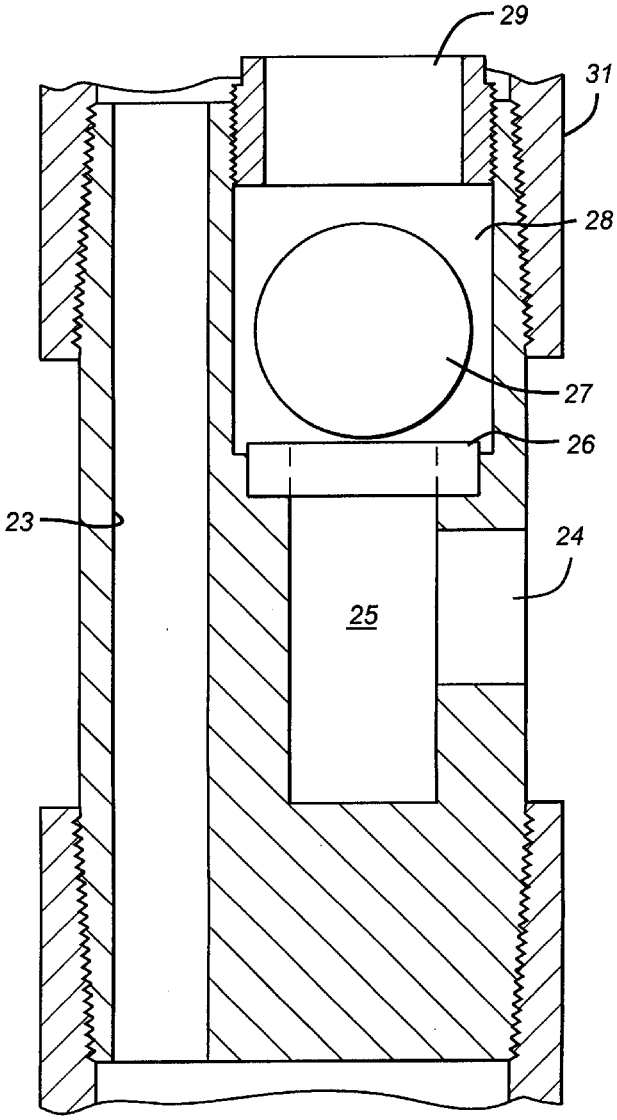
FIG. 3 is a schematic longitudinal cross-sectional view of the upper valve assembly.

Reference is now made to FIGS. 2–7 for a more detailed explanation of the operation of the upper and lower valves, 19 and 20, of the valve assembly. FIGS. 2 and 3 show the upper valve assembly 19 of FIG. 1 in more detail, but still schematically. FIG. 2 is a view looking down on the top of the upper valve assembly shown generally as 21. The valve assembly 21 is machined from a block of steel and is threaded by threads 22 on its extension surface to fit a standard sized production tubing collar 31 (FIG. 3). Three discharge holes 23 or passages are bored through the body 21 of the valve assembly. A fluid input port 24 is bored in the right side (FIG. 3) of the body member 21 and leads to an interior chamber 25 which can be closed off at its upper end by ball in cage valve 27-28 when the ball 27 sealingly engages the valve seat 26. The chamber 25 is in fluid communication with the tubing interior and discharge passages 23 via upper opening 29 when the cage ball valve 27-28 is not closed. On the upstroke of the pump 12, ball 27 leaves seat 26 because of reduction of pressure below the pump 12 in tubing 14. Water enters the tubing 14 via port 24 and opening 29. On the downstroke of pump 12, increased pressure in tubing string 14 closes cage ball valve 27-28 by seating the ball against seat 26, thereby sealing off the casing-tubing annulus from the interior of the tubing string 14. Fluid communication inside the tubing string is maintained via discharge passages 23 below the upper valve assembly.

Figure 4:
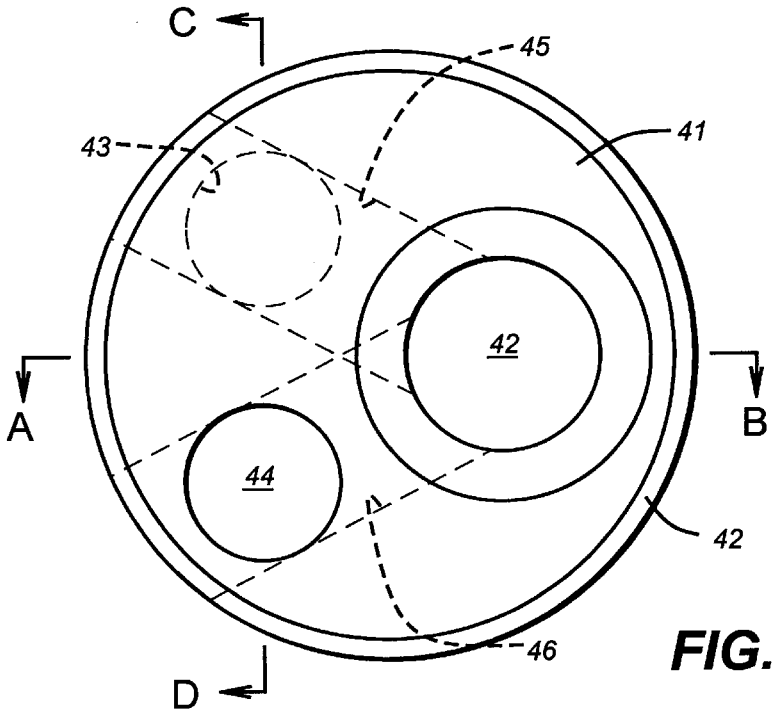
FIG. 4 is a schematic cross-sectional view looking downwardly on the upper end of the lower valve assembly of the system.
Figure 5:
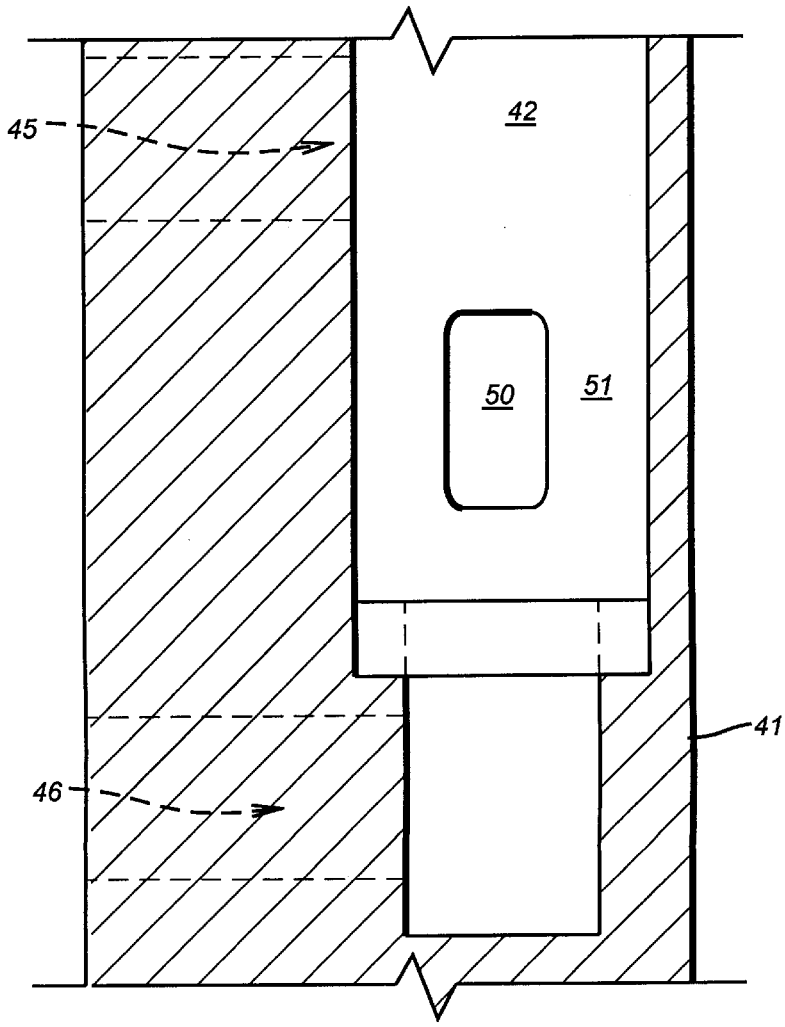
FIG. 5 is a longitudinal cross-sectional view along line A-B of FIG. 4.
Figure 6:
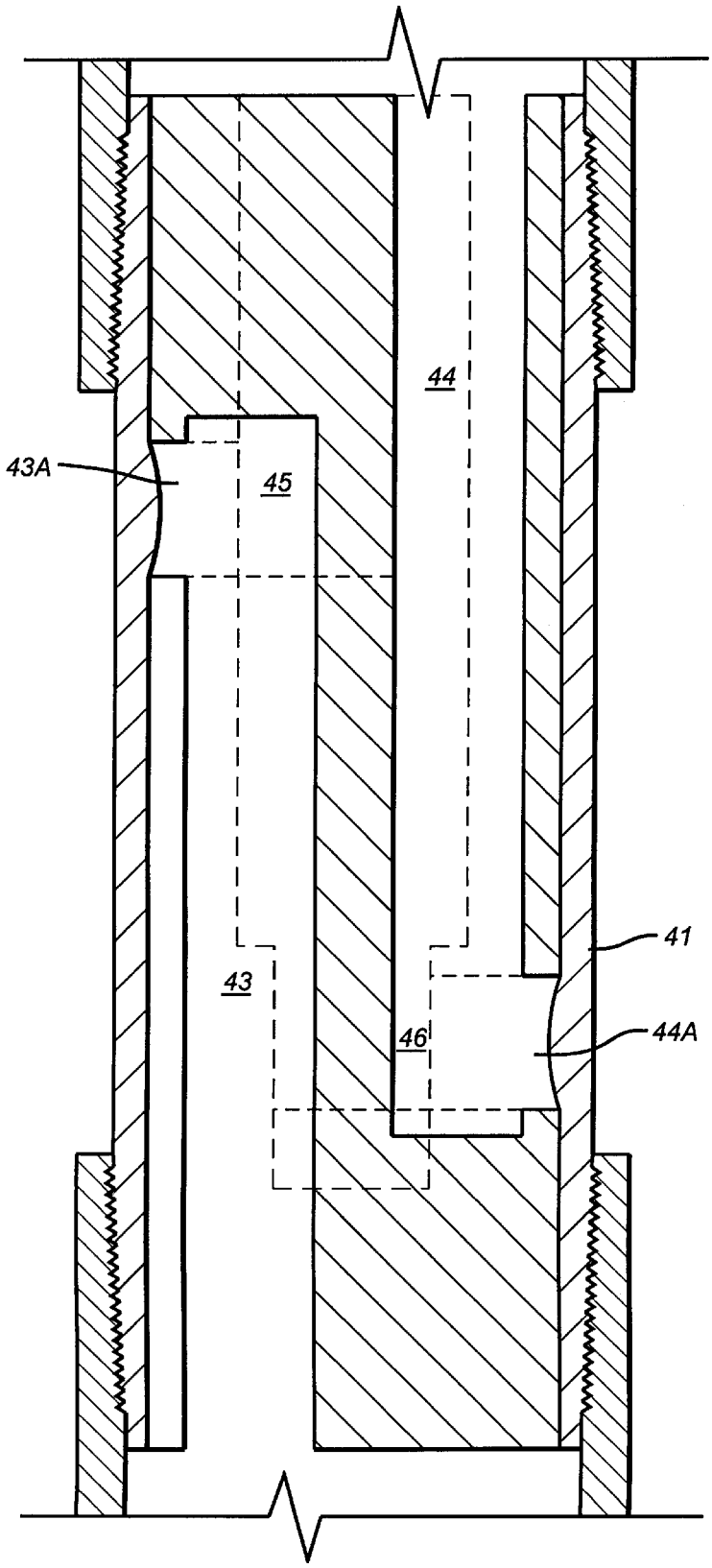
FIG. 6 is a longitudinal cross-sectional view of the lower portion of the lower valve assembly.
Figure 7:
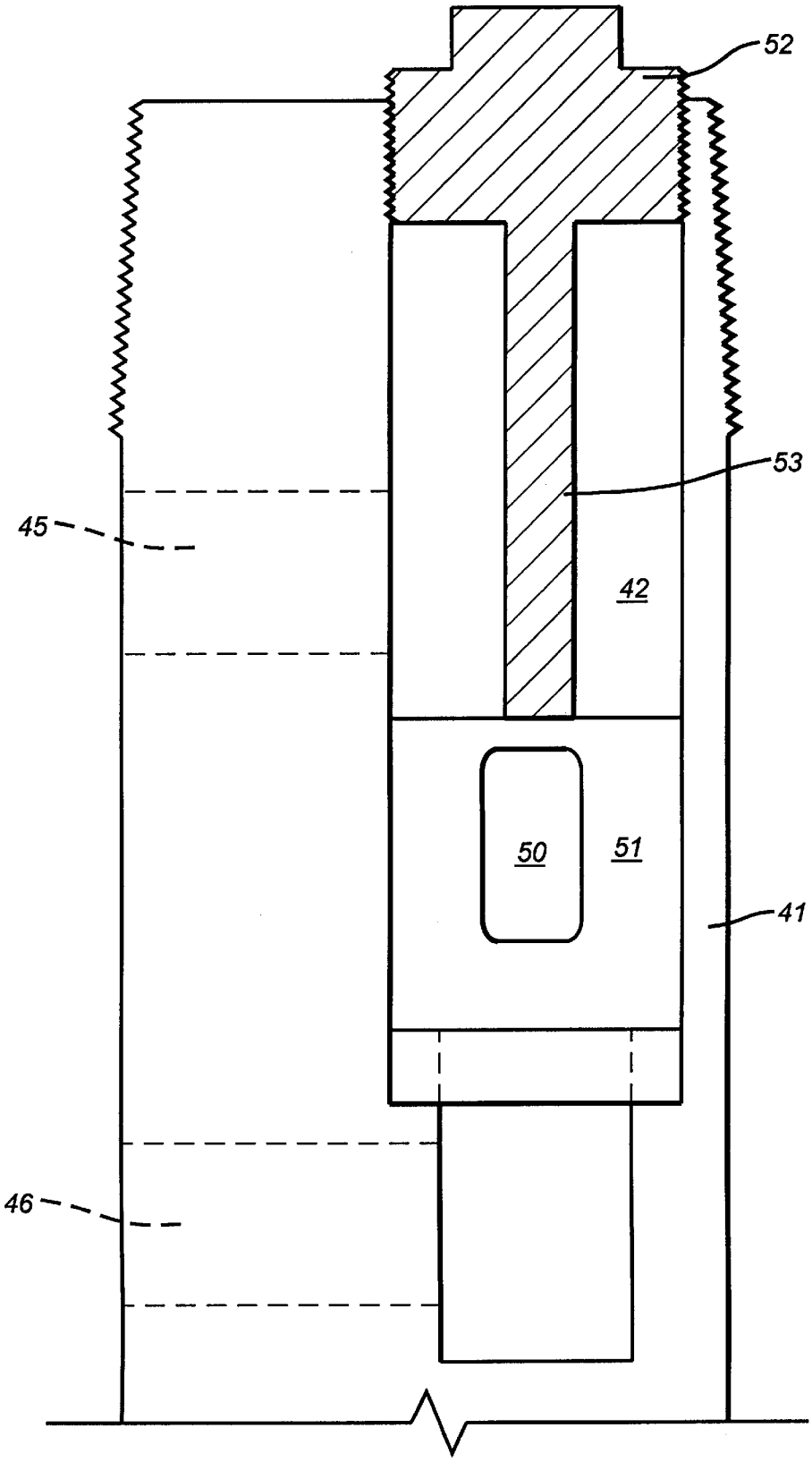
FIG. 7 is a longitudinal cross-section of the valve portion of the lower valve assembly of the system.

Now referring to FIGS. 4–7 the lower valve assembly 20 of FIG. 1 is shown in more detail, but still schematically. FIG. 4 shows a view of the top end of the lower valve assembly looking downwardly on it. Body member 41 is provided with fluid passages 42, 43 and 44 bored therein. The exterior of the body member 41 is threaded with threads 42 to fit standard tubing collars. Passages 43 and 44 are in fluid communication with passages 42 via interior bores 45 and 46. FIG. 6 is a vertical cross-section along plane C-D (FIG. 4) and FIG. 5 is a vertical cross-section along diameter A-B of FIG. 4. FIG. 7 is a more schematic cross-sectional view of the entire lower valve assembly showing the attachment mechanism for ball and cage valves 50-51 which comprises a compression screw 52 and shaft 53 to press on top of the cage member 51 holding it in place.

Fluid passage 42 is provided near its lower end with a cage ball valve 50-51. Fluid entering from the hole 44 opening into the tubing string 14 from the top of the lower valve assembly is routed via passage 44 to a point below ball-cage valve 50-51.

Fluid entering tubing 14 from below the lower valve assembly is routed via bore 43 and opening 45 to a point above the ball-cage valve 50-51 in bore 42. Thus on the upstroke of pump 12 water tending to enter tubing string 14 is routed via bore 43 and opening 45 to a point above the ball-cage valve 50-51 such that valve 50-51 seats or closes, preventing this water from entering tubing string 14 any further.

On the downstroke of pump 12 the increased pressure in the tubing string 14 above the lower valve assembly routes water via bore 44 and opening 46 to a point in bore 42 below ball-cage valve 50-51. Thus the water is forced below the packer 17 and through the injection perforations by the downstroke action of pump 12.

The foregoing descriptions may make changes and modifications apparent to those of skill in the art. It is the aim of the appended claims to cover all such changes and modifications as fall within the true spirit and scope of the invention.

We claim:

1. A method for improving the economics of production from a producing hydrocarbon well by reducing lifting costs comprising the steps of:

placing a casing string downhole through a hydrocarbon producing zone in a well borehole;

placing a production tubing string extending downwardly through said casing and forming a casing-tubing annulus therebetween;

placing production perforations and injection perforations in said casing string in upper and lower portions of said producing zone;

placing a production packer penetrated by the lower end of said tubing string in said casing string between said production perforations and said injection perforations;

producing hydrocarbon and water fluids into said casing-tubing annulus through said production perforations and allowing produced fluids to separate into a water head and produced hydrocarbon under the influence of gravity;

placing a cage-ball valve system below a plunger pump activated by upward and downward motion of a rod string extending to the surface of the earth in said tubing string, said entire valve system being located in said tubing string above said production packer; and pumping water from said casing-tubing annulus above said packer through said cage-ball valve system into said injection perforations below said packer while producing hydrocarbon fluids to the surface.

2. The method of claim 1 wherein the step of pumping water into said injection perforations is performed only on the downward motion of said rod string.

3. The method of claim 2 wherein said cage-ball valve system comprises an upper cage ball valve and a lower cage ball valve arranged such that said upper valve opens on the upward motion of said rod string and closes on the downward motion of said rod string.

4. The method of claim 3 wherein said lower cage-ball valve opens on the downward motion of said rod string and closes on the upward motion of said rod string.

5. The method of claim 4 wherein said plunger pump comprises a plugged plunger pump.

6. A system for improving the economics of production from a producing hydrocarbon well by reducing lifting costs, comprising:

a casing string extending downhole in a well borehole penetrating a hydrocarbon production zone therein;

upper production perforations and lower injection perforations in said casing string placed respectively in upper and lower portions of said hydrocarbon production zone;

a production packer placed in said casing string between said upper and lower perforations;

a production tubing string run into the wellbore through said casing string forming a casing-tubing annulus and penetrating said production packer, said tubing string carrying thereon;

a rod string extending to the surface and powering a plunger pump by upward and downward motion thereof and a caged-ball valve system mounted in said tubing string below said plunger pump and located entirely above with said tubing string in fluid communication with said injection perforations below said packer via said valve system, whereby produced hydrocarbon and water flow into said casing tubing annulus and separate and the produced water is injected via said pump and said valve system into said injection perforations while produced hydrocarbon is accumulated in said casing-tubing annulus and produced to the surface.

7. The system of claim 6 wherein said valve system comprises an upper cage-ball valve which opens on an upstroke of said rod string and closes on a downstroke of said rod string.

8. The system of claim 7 wherein said valve system further comprises a lower cage-ball valve which opens on a downstroke of said rod string and closes on an upstroke of said rod string.

9. The system of claim 8 wherein water is pumped to said injection perforations only on the downstroke of said rod string.

10. The system of claim 9 wherein said plunger pump comprises a plugged plunger pump.

* * * * *